US006202569B1

(12) United States Patent
Bailey et al.

(10) Patent No.: US 6,202,569 B1
(45) Date of Patent: Mar. 20, 2001

(54) STACKABLE PALLET SYSTEM

(75) Inventors: Michael G. Bailey, Woodbury; Kenneth Holz, Hastings; Keith G. Thompson, Cottage Grove, all of MN (US)

(73) Assignee: Bailey Nurseries, Inc., St. Paul, MN (US)

( * ) Notice: Subject to any disclaimer, the term of this patent is extended or adjusted under 35 U.S.C. 154(b) by 0 days.

(21) Appl. No.: 09/365,718

(22) Filed: Aug. 3, 1999

(51) Int. Cl.[7] ..... B65D 19/38

(52) U.S. Cl. ..... 108/53.5; 108/55.1; 108/53.1

(58) Field of Search ..... 108/51.11, 53.1, 108/53.3, 53.5, 55.1, 55.5, 57.13, 57.16, 57.31, 56.1

(56) References Cited

U.S. PATENT DOCUMENTS

| | | | | |
|---|---|---|---|---|
| 2,676,776 | * | 4/1954 | Townson, Jr. | 108/53.5 |
| 2,828,932 | * | 4/1958 | De Pew et al. | 108/53.5 |
| 2,940,706 | * | 6/1960 | De Pew | 108/53.5 |
| 3,159,116 | * | 12/1964 | Skubic | 108/53.5 |
| 3,177,823 | * | 4/1965 | Entel | 108/53.5 |
| 3,195,481 | * | 7/1965 | Verguin | 108/53.5 |

FOREIGN PATENT DOCUMENTS

| | | | | |
|---|---|---|---|---|
| 535389 | * | 1/1957 | (CA) | 108/53.3 |
| 2653999 | * | 6/1978 | (DE) | 108/55.1 |

* cited by examiner

*Primary Examiner*—Janet M. Wilkens
(74) *Attorney, Agent, or Firm*—James W. Miller

(57) ABSTRACT

A stackable pallet system comprises a plurality of pallets used for holding and transporting various items, including potted plants such as potted trees, flowers, bushes, etc. When the pallets are to be stacked, two pairs of spacer pipes can be used on a first pallet extending upwardly therefrom. Two elongated saddles are then coupled, one to each pair of spacer pipes, such that the saddles extend between and unite the upper ends of the pairs of spacer pipes. The saddles comprise an upwardly facing, shallow channel which is sized to be slightly larger than at least a portion of the fork pockets contained on the pallet. A second pallet can be lowered down onto a first pallet with the fork pockets, or at least a portion of the fork pockets, being received in the saddle channels. Various containment rings can be coupled to the pipes, in place of or in addition to the saddles, to allow longer trees to be carried on the pallets or to allow double stacking of potted plants on a single pallet.

13 Claims, 3 Drawing Sheets

STACKABLE PALLET SYSTEM

TECHNICAL FIELD

This invention relates to a pallet system for stacking multiple pallets on top of one another in a vertically spaced manner to allow multi-level storage and transportation of items, particularly potted plants, placed on the pallets.

BACKGROUND OF THE INVENTION

There are wholesale plant nurseries, such as Bailey Nurseries, the assignee of this invention, which grow large numbers of potted plants for distribution to various retail greenhouses. Such plants must be shipped in great quantities and often over large distances. This is done by shipping the plants in large semitrailer trucks or similar vehicles. The plants are shipped on pallets which are loaded into the trucks using forklifts.

Whenever potted plants are shipped on pallets, they cannot be directly stacked on top of one another on a single pallet without potentially crushing one another. Thus, potted plants are usually stacked in one level on a single pallet to minimize damage to the plants. It is difficult to stack three or four or more levels of plants on one pallet, as is often done for goods contained in boxes, without damaging at least some of the plants. Accordingly, when pallets carrying only one level of plants are loaded into semitrailer trucks, much of the interior volume of the trailer, i.e. the volume above the single level of plants, is wasted. As a result, placing potted plants in one level on pallets and then simply placing the pallets in a semitrailer truck is not an efficient shipping method.

To increase the efficiency of shipping potted plants on pallets, the assignee of this invention has previously developed and sold a stackable pallet system. This system better utilizes the interior volume of the trailer by allowing multiple pallets to be stacked on top of one another in a vertically spaced manner. While each pallet still contains one level of plants, the pallets themselves can be stacked three of four high within the trailer, thus allowing three or four levels of plants to be carried in the same volume where only a single pallet and a single level of plants was previously carried. This is obviously a much more efficient and desirable shipping method.

However, the pre-existing stackable pallet system had various disadvantages. First, the pallets could be stacked because vertical spacer pipes extended up from each pallet with the top of each pipe having an upwardly facing, mushroom shaped cap. The bottom of the next pallet had a plurality of downwardly facing, mushroom shaped cups. Each cup was designed to fit over and nest with a mushroom shaped cap on one of the spacer pipes.

To stack one pallet on top of another in this known pallet system, relatively precise longitudinal and lateral positioning is required to get the cups and caps to meet and mate with one another. This is difficult to do considering that the pallet being stacked is supported by a forklift. Thus, to position this pallet, the operator has to maneuver or jockey the forklift to move the pallet back and forth and from side to side until the cups overlie the caps. This requires a skilled operator and much practice. Accordingly, there is a need for a stackable pallet system in which the pallets can be quickly and easily stacked without the need for extremely precise positioning of the pallet being stacked.

Another problem with the prior stackable pallet system involved the fork pocket on the bottom of the pallet. This fork pocket was a simple tube extending across the pallet from the front to the back thereof. Again, it is relatively difficult to align the forks of the forklift with these tubes to pick up a pallet.

In addition, the mushroom shaped cups were carried on the bottom of each pallet adjacent the fork tubes such that these cups could be accidentally contacted by the forks of the forklift as the operator was attempting to insert the forks into the fork tubes. The cups could be deformed or damaged, making the pallet more difficult to stack or even rendering the pallet unusable. In addition, the need for separate cups in addition to the fork tubes added to the expense of manufacturing the pallets.

SUMMARY OF THE INVENTION

One aspect of this invention relates to a stackable pallet system which comprises a plurality of pallets each having a support surface on which items to be transported may be placed. At least one upwardly facing channel is carried on each pallet with the channel being spaced above the pallet support surface. At least one downwardly facing coupler is carried on each pallet with the coupler being configured to be received in the channel of another pallet to allow one pallet to be stacked on top of another.

Another aspect of this invention relates to a stackable pallet system which comprises a plurality of pallets each having a support surface on which items to be transported may be placed. Two pairs of upwardly facing sockets are provided on each pallet with the sockets in each pair being aligned with and spaced from one another. At least one set of four spacer pipes is provided with each spacer pipe having a lower end which can be releasably dropped down into one of the upwardly facing sockets on a first pallet. A pair of saddles having a pair of downwardly facing sockets are provided where each saddle can be dropped down onto the upper ends of one pair of spacer pipes, the pair of saddles when so installed being parallel to one another and spaced from one another. Fork pockets on each pallet receive the forks of a forklift. At least a portion of each fork pocket is engageable with one of the saddles to allow one pallet to be stacked on top of another pallet.

Yet another aspect of this invention to a stackable pallet system which comprises a plurality of pallets each having a support surface on which items to be transported may be placed. At least one upwardly facing member is carried on each pallet spaced above the support surface. At least one downwardly facing coupler is carried on each pallet adapted to be engaged with the upwardly facing member to allow one pallet to be stacked on top of another. A containment ring may be attached to the pallet above the support surface such that a portion of the items carried on the support surface of the pallet may be abutted against the containment ring.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
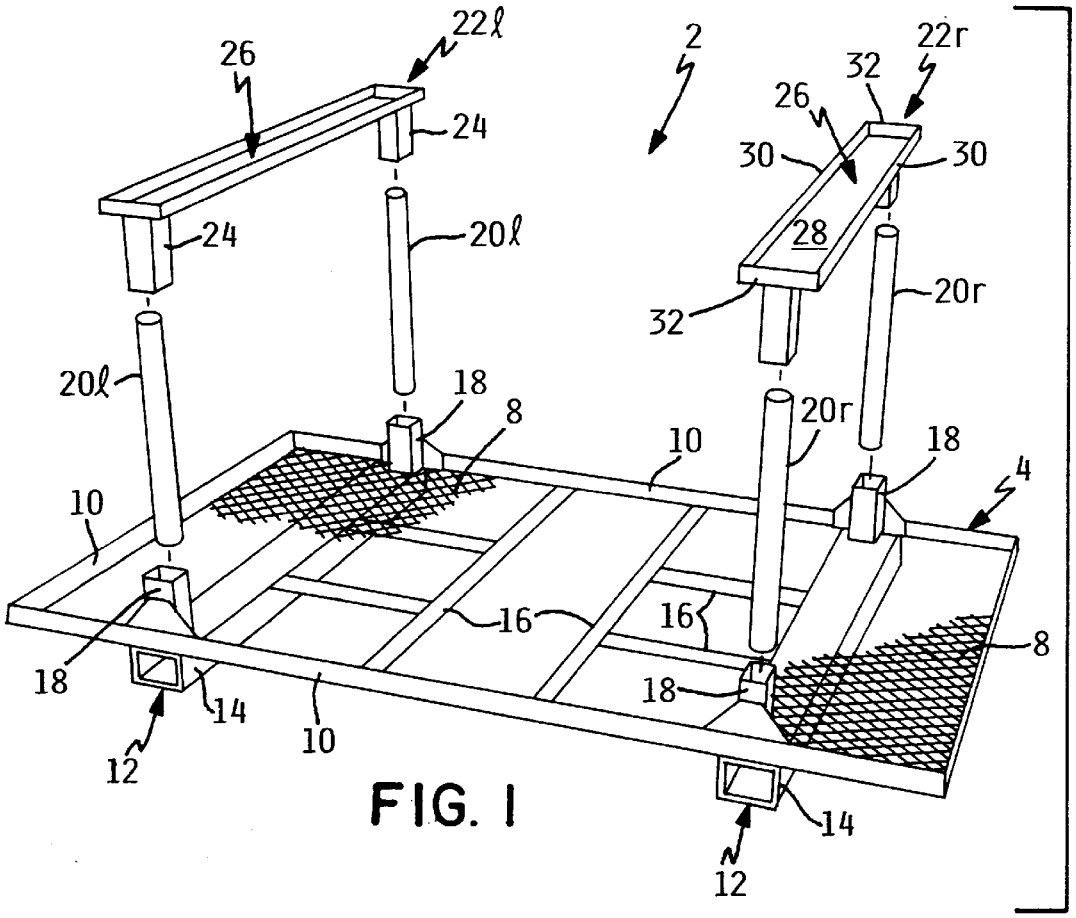
FIG. 1 is a perspective view of various components of the pallet system of this invention, including one pallet, a set of four spacer pipes, and two saddles, shown in an exploded form prior to assembly.

Referring first to FIG. 1, a pallet system according to this invention is generally illustrated as 2. Pallet system 2 comprises a plurality of pallets 4 useful for carrying goods to be shipped, particularly potted plants 6, such as potted bushes, flowers, trees, etc. Pallets 4 are identical. A description of one pallet 4 will serve to describe the other pallets 4.

Pallet 4 comprises a generally flat, planar, support surface 8 that is bounded along its periphery by an upstanding lip 10. Lip 10 extends up a few inches above support surface 8. Lip 10 prevents potted plants 6 placed on support surface 8 from sliding off support surface 8. Support surface 8 preferably comprises a perforated screen material, though support surface 8 could be made from other materials or could be imperforate. Because pallets 4 will be used outdoors, they are preferably made of weather resistant, durable materials. For example, pallets 4 can be made of metallic components that are welded or otherwise suitably secured together.

Figure 2:
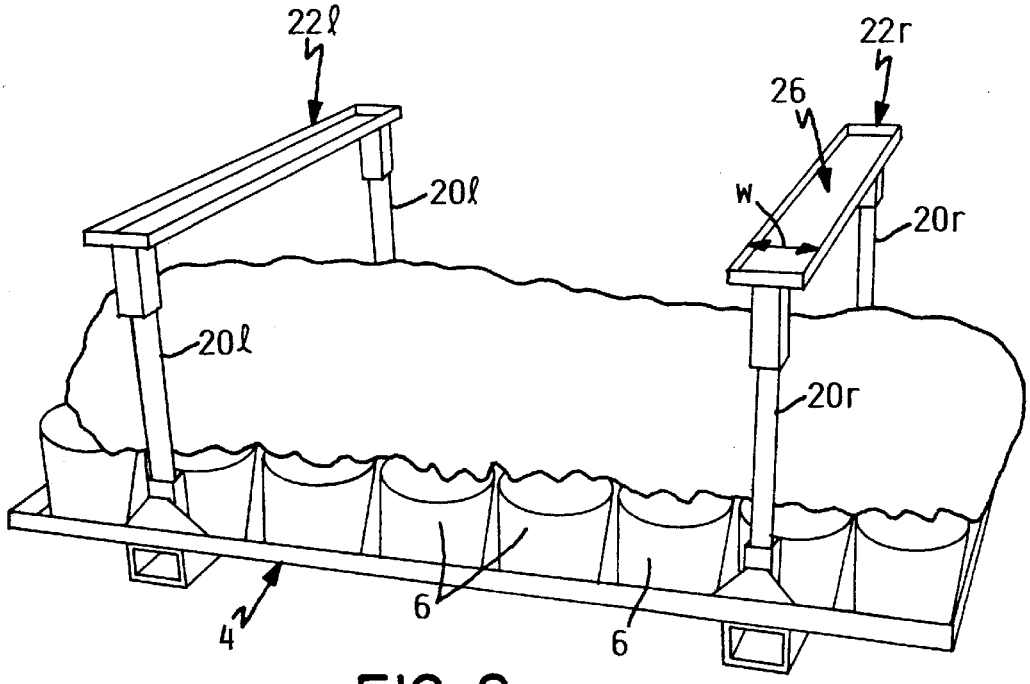
FIG. 2 is a perspective view similar to FIG. 1, but showing the pallet system components of FIG. 1 assembled together with a single level of potted plants on the pallet.
Figure 3:
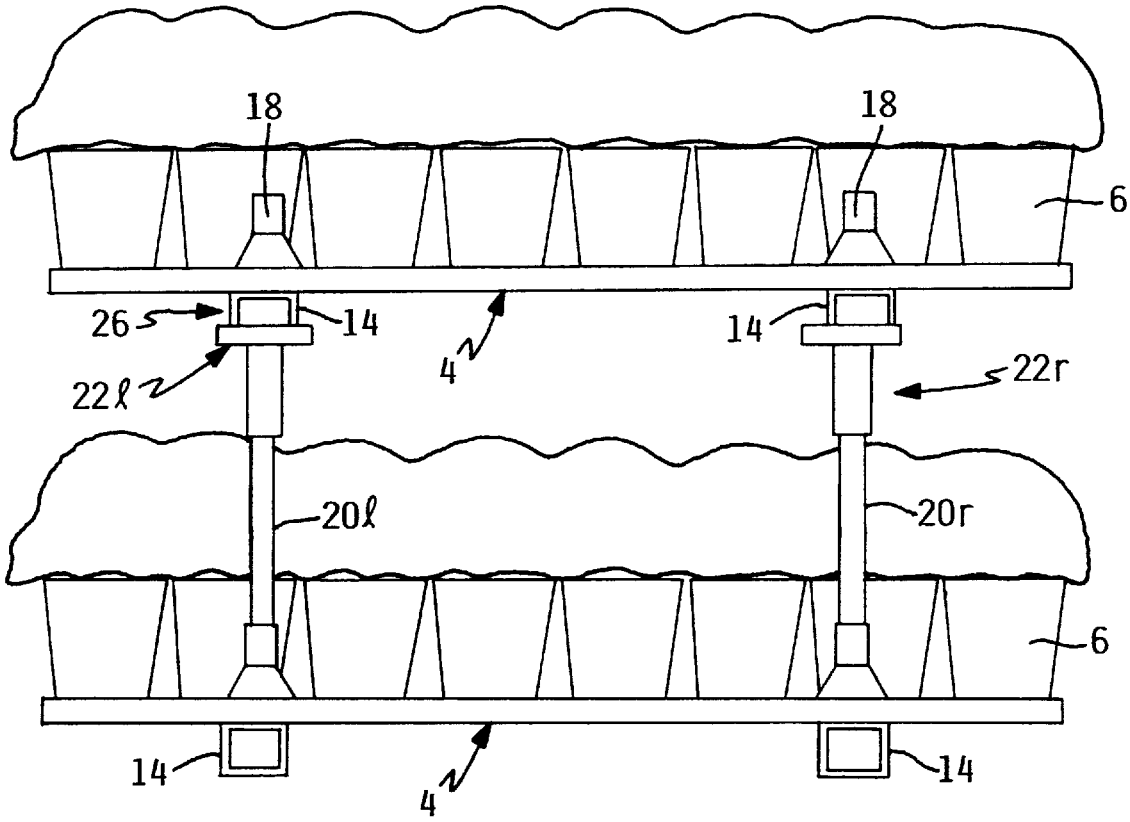
FIG. 3 is a front elevational view of the pallet system of this invention showing two stacked pallets each having a single level of potted plants.

Two fork pockets 12 are located on the bottom of support surface 8 for receiving the forks of a forklift (not shown). Fork pockets 12 are spaced apart by the same distance as the spacing of the forks in a standard forklift. As shown in FIGS. 1–3, in a first embodiment, fork pockets 12 comprise an elongated square or rectangular tube 14 open at both ends thereby allowing insertion of the forks of the forklift into either end of tubes 14. Suitable cross bracing 16 may be added to the bottom of pallet 4 extending between tubes 14 to reinforce support surface 8 of pallet 4 and better support loads carried thereon. Pallet 4 can be picked up, lifted and moved simply by driving a forklift up to pallet 4 and inserting the forks of the forklift into either end of fork pockets 12.

Support surface 8 of pallet 4 includes four upwardly facing sockets 18 adjacent the periphery of pallet 4 located above fork pockets 12. A set of four spacer pipes 20 are provided comprising a left pair of pipes 201 and a right pair of pipes **20*r*. All pipes 20 in any given set of pipes 20 have the same length. Actually, multiple sets of spacer pipes 20 are available for use with pipes 20 in each set having the same length but with pipes 20 in different sets having different lengths. Thus, various sets of spacer pipes 20 could be provided in which the pipes are one foot long, other sets of spacer pipes 20 could be provided in which the pipes are two feet long, and so on. This allows the operator to use whatever set of spacer pipes 20 is needed to achieve a desired amount of spacing between the stacked pallets 4**.

In any event, after a particular set of spacer pipes 20 has been selected for use, each spacer pipe 20 has its lower end inserted into one pallet socket 18 such that spacer pipes 20 extend upwardly from pallet sockets 18 after insertion. FIG. 1 illustrates spacer pipes 20 before they are dropped down into pallet sockets 18. FIG. 2 illustrates spacer pipes 20 after they are dropped down into pallet sockets 18.

A pair of saddles 22 extend across one dimension of pallet 4 between the upper ends of one pair of spacer pipes 20 as shown in FIGS. 1 and 2. Thus, a left saddle 221 extends across pallet 4 to join and unite the upper ends of the left pair of spacer pipes 201. Similarly, a right saddle **22*r* is used to join and unite the upper end of the right pair of spacer pipes 20*r*. Each saddle 22 includes two downwardly facing sockets 24 which allow saddle 22 to be dropped down onto the upper ends of spacer pipes 20. Again, FIG. 1 illustrates saddles 22 before they have been dropped down onto spacer pipes 20 while FIG. 2 illustrates saddles 22 after they have been dropped down onto spacer pipes 20. When saddles 22 are installed on spacer pipes 20, they are spaced from but parallel to one another as shown in FIGS. 1 and 2**.

Each saddle 22 comprises a shallow, upwardly facing channel 26 that is formed by a bottom surface 28 and two spaced, upwardly extending peripheral lips 30. The word "channel" is defined herein to mean any trough, groove or furrow having some depth in the middle and at least two opposed sides or banks. While lips 30 are shown as extending perpendicularly upwardly from a flat bottom surface 28 of channel 26, other channel configurations could be used, such as a shallow, concave trough in which the upper ends of each side of the trough correspond to lips 30. The width of channel 26 is indicated as w in FIG. 2 and comprises the distance between the upper ends of lips 30. The width w of channel 26 is chosen to be somewhat larger than the width of tube 14 that forms fork pocket 12.

The ends of each channel 26 also include spaced, upwardly extending peripheral lips 32 that are joined to lips 30 such that channel 26 is bounded on all four sides by lips 30 or 32. In this form, channel 26 also resembles an upwardly facing tray. However, while lips are preferred on all four sides of channel 26 because such lips help the pallets be self seating when they are stacked, lips 32 could be deleted if so desired. In addition, lips 30 need not necessarily be continuous or extend the entire length of bottom surface 28 as long as they serve to confine or limit sideward movement of a coupler placed on top of bottom surface 28 between lips 30.

As shown in FIG. 2, a first pallet 4 can be loaded with a plurality of potted plants 6 that substantially cover support surface 8 of pallet 4 and are retained thereon by pallet lip 10. To stack another pallet 4 on top of this first pallet 4, the operator selects a set of spacer pipes 20 of any desired length and drops one end of spacer pipes 20 into the upwardly facing sockets 18 of pallet 4. Then, the operator attaches two saddles 22 to the upper ends of spacer pipes 20 by dropping saddles 22 down onto the upper ends of a pair 201 or **20*r* of spacer pipes, the downwardly facing sockets 24 on each end of saddle 22 simply slipping down over the upper ends of spacer pipes 20. When so assembled, these components will appear as they do in FIG. 2, i.e. a first, loaded pallet 4 is depicted with four spacer pipes 20 and two saddles 22** having been assembled thereon.

Another pallet 4 can then be loaded with a plurality of potted plants 6 similarly to the first pallet. The operator then inserts the forks of the forklift into fork pockets 12 on this second pallet. Then, using the forklift, the operator positions the second pallet over the first pallet with fork pockets 12 on the second pallet being located in alignment with but spaced above the upwardly facing channels 26 that form saddles 22. The operator then simply slowly lowers the forks of the forklift until fork pockets 12 are received in the channels 26 of saddle 22 between saddle lips 30. Fork pockets 12 form couplers for coupling the second pallet 4 to a first pallet. FIG. 3 shows a second loaded pallet after that pallet has been dropped down into saddle channels 26.

While FIG. 3 shows only two pallets 4 stacked on top of one another, each pallet 4 includes a set of upwardly extending sockets 18 for coupling spacer pipes 20 thereto. Accordingly, another set of spacer pipes 20 could be attached to the upper, second pallet 4 shown in FIG. 3 and another pair of saddles 22 could be attached to these spacer pipes 20. This would allow the stacking of a third pallet 4 on top of the two stacked pallets 4 shown in FIG. 3. Obviously, this can be repeated as many times as desired until the vertical volume or space in which potted plants 6 are to be shipped has been filled.

The use of channels 26 to receive fork pockets 12 is a particularly advantageous way of stacking pallets 4 on top of one another. It lets fork pocket 12 do double duty both in terms of receiving the fork of the forklift and also in terms of serving as a coupler that is received in a channel 26. No separate coupling member, other than fork pocket 12, is required.

However, couplers that are completely separate from fork pockets 12 could be used on the bottom of pallet 12 if so desired to connect into channels 26 on saddles 22. In addition, fork pockets 12 could be deleted. Thus, the bottom of each pallet 12 could have two downwardly extending couplers of almost any cross-sectional configuration. In such an embodiment, the couplers could comprise a channel iron or an I-beam welded to the bottom side of pallet 12 with the bottom flange of the channel iron or I-beam serving to nest within one of the channels 26. Moreover, such nonfork pocket type couplers could be spaced apart wider than the forks on a forklift without there being any fork pockets such that the forks on the forklift would simply engage the bottom of the pallet and lift up on the pallet at some location between the two couplers. Thus, using the fork pockets or a portion of the fork pockets as a coupler is not an essential part of this invention.

Using a channel 26 that is slightly oversized relative to fork pocket 12 greatly eases the task of stacking pallets 4. It is easier for the operator to align fork pockets 12 with channels 26 and to drop fork pockets 12 down into channels 26 using a forklift than the prior art system of dropping mushroom shaped cups down onto mushroom shaped caps. In addition, lips 30 of channel 26 will engage against the sides of fork pocket 12 when fork pocket 12 is received in channel 26 to prevent fork pocket 12 from laterally sliding out of channel 26. Thus, a secure connection is made between adjacent pallets.

Obviously, the length of fork pocket 12 is also chosen to allow fork pocket 12 to be received between lips 32 when fork pocket 12 is received within channel 26. This further secures fork pocket 12 to channel 26 by preventing fork pocket 12 from sliding longitudinally out of channel 26.

Figure 4:
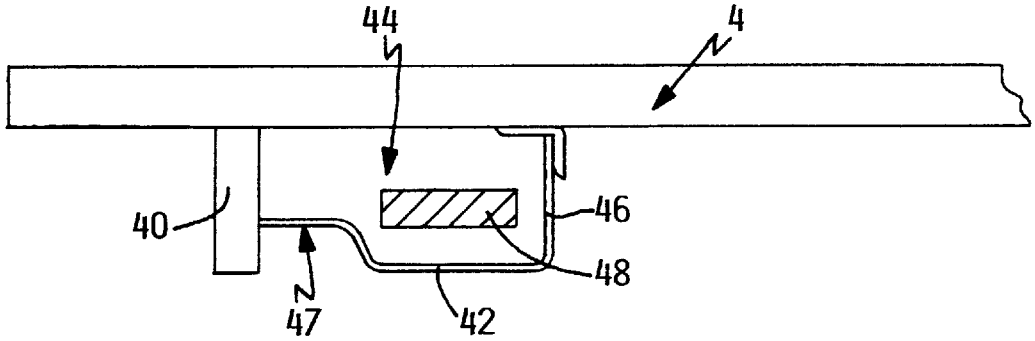
FIG. 4 is an enlarged front elevational view of an alternative embodiment of a fork pocket for the pallet shown in FIG. 1.

FIG. 4 shows an alternative version of fork pocket 12. Rather than being a continuous tube 14 that extends across pallet 4, fork pocket 12 now partially comprises a solid, relatively narrow side rail 40 which extends all the way across pallet 4 on the bottom of pallet 4. A strap 42 is secured to side rail 40 at each end of side rail 40 by being welded to side rail 40 and to the underside of pallet 4. Thus, one strap 42 will be attached to side rail 40 and pallet 4 at one end of side rail 40 and another strap 42 will be attached to side rail 40 and pallet 4 at the other end of side rail 40. Only one such strap 42 at one end of side rail 40 is depicted in FIG. 4.

The opening 44 between side rail 40 and a vertical leg 46 of strap 42 is the space or cavity into with the fork 48 can be inserted. opening 44 is much wider than the width of fork 48 to ease the task of inserting the fork into fork pocket 12.

Strap 42 includes a raised, upwardly offset portion 47 adjacent the point at which strap 42 attaches to side rail 40. This is to allow side rail 40 to fit down into channel 26 of saddle 22, the offset strap portion 47 being raised sufficiently to clear saddle lip 30 when side rail 40 is resting against bottom surface 28 of channel 26. Again, side rail 40 is even narrower than tube 24 shown in FIGS. 1–3, thus making it even easier to nest side rail 40 within channel 26. Thus, the alternative fork pocket 12 of FIG. 4 has an enlarged fork receiving space 44, compared to tube 14 of FIGS. 1–3, and a narrower rail 40, compared to tube 14 of FIGS. 1–3, which simultaneously makes it easier to pick pallet 4 up with a forklift and to drop pallet 4 down into channels 26 on a first pallet.

Figure 5:
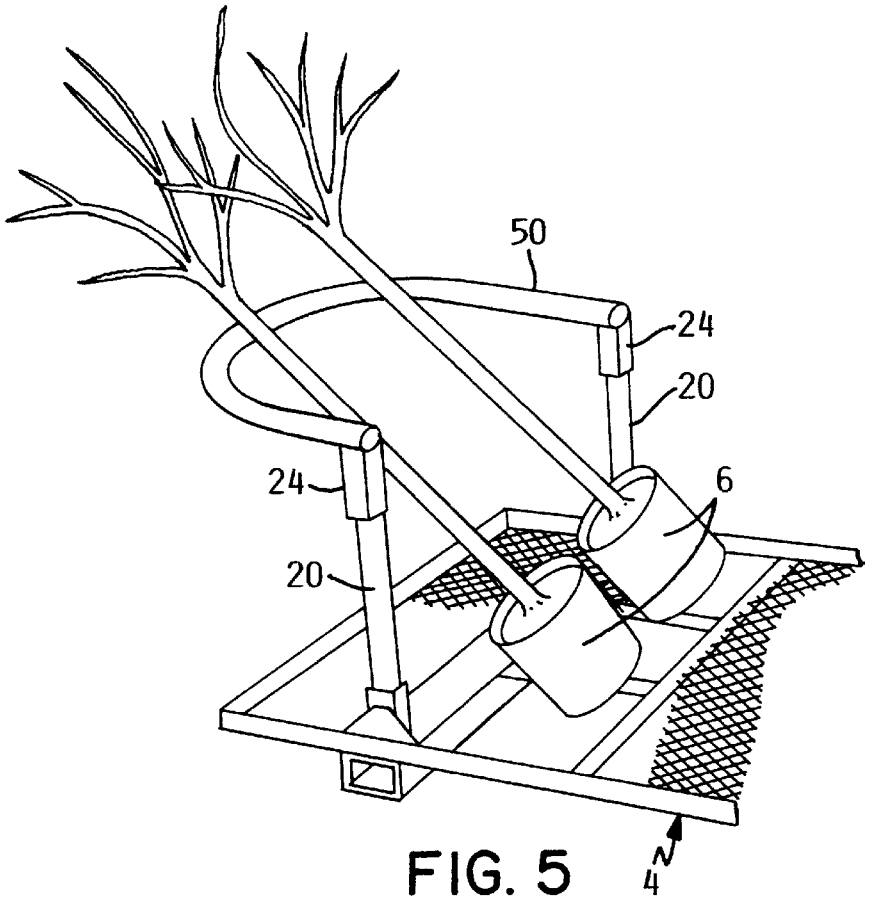
FIG. 5 is a perspective view of a tree containment ring of the pallet system of this invention.

Referring now to FIG. 5, taller potted plants 6, such as trees, can also be shipped on pallet system 2 of this invention. This can be done by using at least one pair of spacer pipes 20 on one end of pallet 4 as shown in FIG. 5. A U-shaped tree containment ring 50 having two downwardly facing sockets 24 can then be dropped down onto the upper ends of this pair of spacer pipes 20 in place of saddle 22. Then, the potted trees can be placed on support surface 8 of pallet 4 in a tilted orientation with the trunks of the trees being supported by the U-shaped tree containment ring 50. A similar tree containment ring 50 could be used on the other end of pallet 4 to support other potted trees that are tipped in the opposite direction to the trees shown in FIG. 5.

Figure 6:
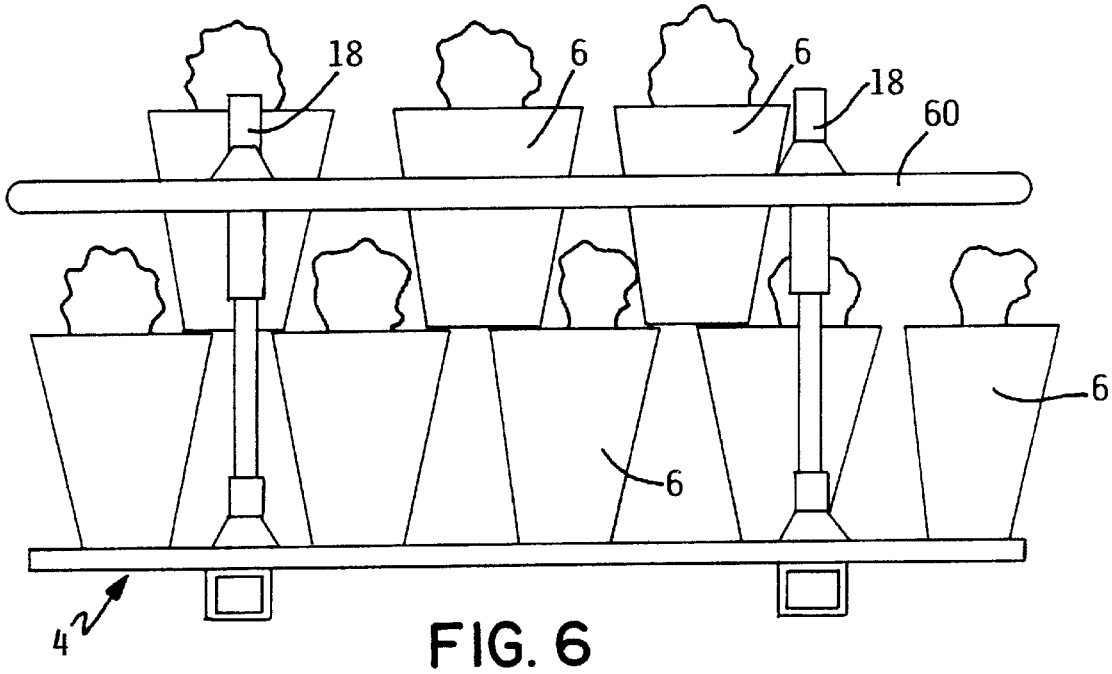
FIG. 6 is a front elevational view of a 360° plant containment ring of the pallet system of this invention which allows double stacking of potted plants, i.e. stacking in two levels, on a single pallet.

FIG. 6 shows the use of a single pallet 4 to double stack potted plants 6 in two levels. In this embodiment, a rectangular, tubular containment ring 60 which is open in the middle but which otherwise extends for 360° is used such that the ring essentially overlies the periphery of pallet 4. Then, two levels of potted plants can be stacked on pallet 4 with the outermost plants 6 in the upper level of plants being contained and restrained by containment ring 60. The upper side of containment ring 60 could be provided with upwardly facing sockets 18 to allow more spacer pipes 40 to be added along with saddles 22 to permit multiple stacking of pallets 4. Thus, if containment rings 60 as disclosed in FIG. 6 are used, one could have multiple stacked pallets 4 each having a containment ring 60 thereon to allow double stacking of potted plants on each pallet 4.

Various modifications of this invention will be apparent to those skilled in the art. Thus, the scope of this invention is to be limited only by the appended claims.

We claim:

1. A stackable pallet system, which comprises:

(a) a plurality of pallets each having a support surface on which items to be transported may be placed;

(b) at least two upwardly facing channels carried on each pallet with the channels being spaced from and parallel to one another above the pallet support surface;

(c) at least two downwardly facing couplers carried on each pallet with the couplers being spaced from and parallel to one another, each coupler on one pallet being received in one of the channels of another pallet when one pallet is stacked on top of another; and (d) wherein each pallet has at least two fork pockets for allowing a forklift to engage and transport each pallet, and wherein each coupler comprises at least a portion of one fork pocket, wherein each fork pocket is formed from a side rail having a strap secured to each end of the side rail, the strap and side rail together forming an opening at each end of the side rail into which one fork of the forklift can be inserted, the side rail of the fork pocket being configured to be received within the channel such that the side rail forms the coupler.

2. The pallet system of claim 1, wherein the channels and the couplers each extend substantially across one dimension of each pallet between opposite sides of each pallet.

3. The pallet system of claim 1, wherein, for each fork pocket the strap has a raised, offset portion adjacent the side rail to allow the side rail to be received within the channel without interference from the strap.

4. The pallet system of claim 3, wherein the channels are releasably attachable to each pallet.

5. The pallet system of claim 3, wherein each pallet includes a plurality of upwardly extending spacer pipes disposed in two pairs with the spacer pipes in each pair being spaced from one another, each of the channels being releasably attachable to the upper ends of one pair of the spacer pipers.

6. The pallet system of claim 5, wherein each channel has two downwardly facing sockets which can be dropped down over the upper ends of the one pair of spacer pipes.

7. The pallet system of claim 6, wherein each pallet includes a plurality of upwardly facing sockets into which lower ends of the spacer pipes may be dropped to releasably secure the spacer pipers to the pallet.

8. The pallet system of claim 1, further including a containment ring that may be attached to each pallet such that a portion of the items carried on the support surface of each pallet may be abutted against the ring.

9. The pallet system of claim 8, wherein the containment ring is U-shaped and is located at one end of the pallet, and wherein the items carried on the support surface comprise trees that may be placed on the support surface and leaned over until the trees have a portion thereof in engagement with the containment ring.

10. The pallet system of claim 8, wherein the containment ring extends substantially 360° around the pallet to generally overlie a periphery of the pallet, and wherein the items carried on the support surface comprise potted plants that may be double stacked on the support surface in first and second levels with the outermost plants on the second level of plants being in engagement with and restrained by the containment ring.

11. A stackable pallet system, which comprises:

(a) a plurality of pallets each having a support surface on which items to be transported may be placed;

(b) two pairs of upwardly facing sockets provided on each pallet with the sockets in each pair being aligned with and spaced from one another;

(c) at least one set of four spacer pipes with each spacer pipe having a lower end which can be releasably dropped down into one of the upwardly facing sockets on a first pallet;

(d) a pair of saddles having a pair of downwardly facing sockets to allow each saddle to be dropped down onto the upper ends of one pair of spacer pipes, the pair of saddles when so installed being parallel to one another and spaced from one another; and (e) fork pockets on each pallet for receiving the forks of a forklift, at least a portion of each fork pocket being engageable with one of the saddles to allow one pallet to be stacked on top of another pallet.

12. The pallet system of claim 11, wherein the saddles comprise upwardly facing channels bounded by a lip or rim on at least two opposed sides thereof, and wherein the portion of each fork pocket engageable with the one saddle is received in the channel between the lip or rim on the at least two opposed sides of the channel.

13. The pallet system of claim 12, wherein the saddles comprise upwardly facing channels bounded by a lip or rim on all four sides thereof, and wherein the portion of each fork pocket engageable with the one saddle is received in the channel between the lip or rim on the four sides thereof.

* * * * *